United States Patent [19]

Rogers et al.

[11] Patent Number: 4,914,780

[45] Date of Patent: Apr. 10, 1990

[54] COMPOUND COUNTERBALANCE AND WINDING SYSTEMS WITH ZERO TORQUE SPIRALS

[75] Inventors: Tracy G. Rogers, Rochester, N.Y.; Michael R. Nier, Harrisburg, Pa.

[73] Assignee: Schlegel Corporation, Rochester, N.Y.

[21] Appl. No.: 227,191

[22] Filed: Aug. 2, 1988

[51] Int. Cl.[4] ..... E05F 1/16

[52] U.S. Cl. ..... 16/193; 16/1 C; 16/196; 16/198; 16/DIG. 16; 16/DIG. 31; 49/445; 49/446

[58] Field of Search ..... 16/1 C, 193, 196, 197, 16/198, DIG. 16, DIG. 31; 49/445, 446

[56] References Cited

U.S. PATENT DOCUMENTS

| | | | |
|---|---|---|---|
| 97,263 | 11/1869 | Anderson . | |
| 1,669,990 | 5/1928 | Mantz . | |
| 1,722,250 | 7/1929 | McKee | 16/DIG. 31 |
| 2,010,214 | 8/1935 | Braun | 16/198 |
| 2,262,990 | 11/1941 | Cross et al. | 16/197 |
| 2,453,424 | 11/1948 | Foster | 16/198 |
| 2,774,119 | 12/1956 | Osten . | |
| 2,952,884 | 9/1960 | Dinsmore . | |
| 3,046,618 | 7/1962 | Teggelaar . | |
| 3,055,044 | 9/1962 | Dinsmore | 16/197 |
| 3,095,922 | 7/1963 | Frazier | 160/191 |
| 3,335,455 | 8/1967 | Anderson | 16/198 |
| 3,615,065 | 10/1971 | Elliot | 242/107 |
| 4,012,008 | 3/1977 | Hosooka | 242/107 |
| 4,078,336 | 3/1978 | Prosser | 49/445 |
| 4,238,907 | 12/1980 | Swan | 49/446 |
| 4,760,622 | 8/1988 | Rohrman | 16/198 |

*Primary Examiner*—Kenneth J. Ramsey
*Assistant Examiner*—Edward A. Brown
*Attorney, Agent, or Firm*—Steele, Gould & Fried

[57] ABSTRACT

A compound counterbalance system for window sashes and the like, comprising: a biasing spring for easing operation of a window sash and the like, the biasing spring being movable at an inherently variable rate of force; a first biasing force transmission having a fixed rate of movement transmission part connected to the biasing spring and a variable rate of movement transmission part connected to the window sash and the like, the variable rate of movement transmission part having a variable rate of operation predetermined to automatically compensate for the variability of the biasing spring to provide substantial constancy of the biasing force throughout an operating range; and, a cable for interconnecting the biasing spring, the first biasing force transmission, and the window sash and the like, whereby loading forces on the first biasing force transmission are substantially constant throughout the operating range. The system may further comprise one or both of a second biasing force transmission connected intermediately of the variable rate of movement transmission part and the window sash and the like, for increasing the effective range of movement of the biasing spring; and, an adjuster for changing the effective magnitude of the biasing force throughout the operating range.

20 Claims, 5 Drawing Sheets

COMPOUND COUNTERBALANCE AND WINDING SYSTEMS WITH ZERO TORQUE SPIRALS

BACKGROUND OF THE INVENTION

1. Field of the Invention

This invention relates to the field of compound winding apparatus and to counterbalance systems for window sashes and the like, and more particularly, to a compound counterbalance system incorporating a compound winding apparatus with a zero torque spiral configuration.

2. Prior Art

Counterbalance systems for window sashes and the like have been known for some time, particularly in conjunction with double hung window frames. The original counterbalance systems for such windows utilized sash weights hung by cables and pulleys, and running in large cavities to one or both sides of the window frames. Such counterbalance systems made such windows practical, but at the same time, were extremely energy inefficient. The large cavities in which the pulleys were disposed provided effective conduits for drafts running along and through the windows and the walls in which the windows were mounted. Such counterbalance systems did have one advantage, namely that the pull exerted by the sash weight was constant throughout the reciprocating range of movement of the window sashes.

A number of developments have impacted on the design of windows and counterbalance systems for windows, resulting in the inevitable obsolescence of the sash weight and pulley system. Technology has been developed to manufacture windows much less expensively off-site, in fully functioning assemblies. Such assemblies incorporate within their own structure the necessary counterbalance system. Cavities for sash weights to counterbalance windows are no longer even designed or otherwise provided for today. Accordingly, spring balances were incorporated into such manufactured window assemblies. Spring balances are advantageous in that their tension can be easily adjusted, whereas changing sash weights is a major undertaking. The ability to provide adjustable tension has proven especially important today, as energy conservation requirements demand that windows be very tightly sealed against drafts and that they provide substantial insulation. It is not generally appreciated by consumers at large that highly efficient weather stripping and weather seals exert large amounts of sliding friction, making windows and other systems incorporating such seals much more difficult to operate. Adjustably tensioned springs permit manufacturers to compensate for the additional tension which is necessary for a well-sealed and well-insulated window. Insulated windows require additional panes of glazing, increasing the weight of the sash. However, counterbalance systems incorporating springs have simply never worked as well as did sash weights, when windows were substantially unsealed, because such springs have inherent unconstant spring rates or gradients, that is, the amount of tension exerted by the spring changes according to the extent to which the spring is extended or relaxed.

In today's marketplace, window manufacturers are faced with two critical goals, namely achieving thermal efficiency (i.e., insulation and very low air infiltration), and at the same time, achieving low operating forces.

There is a direct conflict in these two goals, as tightly-fitted, heavy window assemblies inherently generate higher operating forces due to friction and gravity. Today's counterbalance systems are simply not responsive to today's needs.

As might be expected, the prior art is replete with counterbalance systems for window sashes and the like, in what seems to be, at least initially, the widest variety of mechanical systems. A number of patent references disclose the use of spiral drums to compensate for tension changes in a spring, but in each instance, the spiral drum appears to have been mounted coaxially with and axially driven by the spring, and both the spring and the spiral drum have been disposed in a cavity above or below the window. Moreover, none of these patent references has used the spiral drums in further combination with a pulley system or other means for imparting a mechanical advantage, which in turn increases the effective range of movement of the biasing means. The following United States patents are representative of such teachings: 97,263; 1,669,990; 2,010,214; 2,453,424; 3,095,922; 3,615,065; and, 4,012,008.

Patent references have also disclosed windows utilizing side mounted springs and pulley systems, most of the pulley systems being arranged in a block and tackle arrangement to achieve a mechanical advantage. However, the systems disclosed in these references require all available space, and none incorporates a means compensating for changes in spring tension. United States patents representative of such teachings include: 2,262,990; 2,952,884; 3,046,618; 3,055,044; 4,078,336; and, 4,238,907.

Certain references have also provided alternative solutions to compensation of variable spring rates in tensioning means, other than spiral drums and in other contexts. In U.S. Pat. No. 4,389,228 the sheaves of the pulleys are so close together that only one diameter of rope or cable can fit there between. The effective diameter of the pulley therefore changes with each rotation as more of the cable is wound onto, or paid out from the drum. Other solutions are disclosed in the following U.S. Pat. Nos.: 2,774,119 and 3,335,455.

3. Related Applications

This application represents further development of the invention disclosed in commonly owned U.S. application Ser. No. 892,704, now U.S. Pat. No. 4,760,622.

The invention of the commonly owned application was embodied in a new compound winding apparatus and counterbalance system for window sashes and the like. A compound counterbalance system according to that invention is the first such system sufficiently compact and sufficiently efficient to interconnect and utilize: (1) an axially expansible and contractable biasing means; (2) a constant rate of movement system providing a mechanical advantage, and reduction in space requirements; and, (3) a variable rate of movement system to automatically compensate for inherent variability in the tension of the biasing means. Moreover, the biasing means itself is adjustable. Finally, compound counterbalance systems according to that invention are easily incorporated into off-site manufactured assemblies.

The term mechanical advantage, as used in the constant rate of movement system, requires some clarification to be meaningful in context. There is a "cost" for every mechanical advantage. In the context of pulleys, as used in block and tackle assemblies, one can achieve significant mechanical advantage in raising a heavy load, but the load moves at a speed which is inversely proportional to the ratio of mechanical advantage, that is, much slower. The distance through which the load moves is also much less than the supporting cable at its driven end. In the context of gear systems, the "cost" is a rotational speed reduction. Where speed is more important than power, a mechanical disadvantage is preferred, as in an automobile's overdrive transmission. In the context of levers, a longer moment arm for the driven end of a lever will move a heavier load, but through a shorter distance, relative to the driven end. For this invention, a window sash or the like must move further than the expansion space available for, as an example, an axially extensible spring; considerably further.

The various mechanical advantage systems utilized in that invention enable maximum range of sash movement and, at the same time, minimum range of movement for expansion for appropriate parts of the biasing means. Nevertheless, the various embodiments maintain a mechanical advantage in stressing or extending the biasing means. Compound counterbalance systems according to that invention successfully exploit the "cost" of mechanical advantage systems without, in fact, sacrificing all of the benefits. Moreover, the variable rate of movement system, which is embodied in a compound winding apparatus and compensates for variability in the tension of the biasing means, can be embodied in small dimensions which further reduce space requirements for window sashes and in other applications.

The system described in U.S. patent application Ser. No. 892,704 represented a radical departure from the prior art, and in that regard, provides many, very significant advantages. However, under certain load and operating conditions, the system is subject to problems. In a mechanical sense, these problems flow from the direct connection of the variable rate spring to the variable diameter portion of the pulley; the fixed diameter or drum portion of the pulley being connected to the sash, through the constant rate of movement system.

4. Theoretical Considerations

In the prior commonly owned patent the sash force, which is constant, is applied to a constant radius drum while the linearly changing spring force is applied to a spiral of constantly changing radius. The arrangement is illustrated schematically in FIG. 2*a*. As the force due to the spring increases, the moment on the spiral remains constant since the radius of the spiral decreases. This relationship can be expressed mathematically, as shown in Equation 1. The left side of the equation is representative of the sash/drum side of the system where "F" is the constant force due to the sash (and which may be deemed to include the constant effect of the constant rate of movement system) and "$r_d$" is the constant drum radius. The linearly changing spring force and changing spiral radius are represented by "x" and "y", respectively, on the right side of the equation.

$$F \cdot r_d = x \cdot y \qquad \text{Equation 1}$$

Since "F" and "$r_d$" are constants, their product is a constant throughout the operation of the sash and the left side of the equation can be represented as the single constant, "d".

The force due to the spring is a linearly changing variable and so is raised to an exponent of the first power or "$x^1$". The relationship between the spiral radius and its rotational position is given by Equation 2.

$$\theta = C - \frac{\sqrt{s^2 - r^4}}{2r^2} - \frac{1}{2}\sin^{-1}\frac{r^2}{s} \qquad \text{Equation 2}$$

where:

o=rotational position of spiral in radians;

s=sash force/spring constant;

r=radial position of spiral; and,

C=constant of integration.

As is seen, there is a squared relationship between the radial and rotational position of the spiral such that the changing spiral radius, "y", of equation 1 is raised to the second power and is represented as "$y^2$". Replacing the above parameters into Equation 1 results in Equation 3.

$$d = x^1 y^2 \qquad \text{Equation 3}$$

where:

d=sash/drum constant;

x=spring force; and, y=spiral radius.

The terms "x" and "y" are in a dependent linear relationship since a change in "x" necessitates a proportional change in "y". They may therefore be multiplied for illustration and be represented as shown in Equation 4.

$$d = z^3 \qquad \text{Equation 4}$$

where:

d=sash/drum constant; and, $z^3$=spiral/spring relationship.

This illustrates the cubic relationship between the sash/drum side of the system and the spiral/spring side of the system.

The system may also be analyzed as the combination of independent and dependent variables. Since there is no change in the force of the sash or in the radius of the drum, these variables are independent of any other factors at any given time and are, therefore, constants. Conversely, both the spring force and the spiral position are dependent upon the location of the sash and upon each other at all times. The previous example, in terms of Equation 1, would be expressed as Equation 5.

$$\textit{independent} \cdot \textit{independent} = \textit{dependent} \cdot \textit{dependent} \qquad \text{Equation 5}$$

Equation 5 is "unbalanced", as between independent and dependent variables. The dependent variables are affected not only by external factors but also by each other, which leads to their cubic relationship. Relating the multiplication of independent and dependent variables in terms of Equation 4 would be expressed as Equation 6:

$$\textit{independent constant} = (\textit{dependent variable})^3 \qquad \text{Equation 6}$$

where:

independent constant=sash/drum constant dependent variable=spiral/spring relationship The relationship, which can be thought of as "unbalanced", creates problems in a number of areas. The first of these problems is that of force multiplication over the spiral. Since the cord from the sash/reduction block must wrap on the drum, the drum must be of a substantial diameter to wrap this cord in only a few turns. For example, in a system designed for a sash with a 24" travel on a 4:1 reduction block, a drum diameter of 0.955" is necessary to keep total rotation of the spiral/drum under 2 revolutions. If this diameter were to be decreased, the number of revolutions of the spiral/drum would increase and the spiral would be excessively long, which leads to space restrictions within the window frame. In the past, an inner spiral diameter of 0.50" has been found to yield a spiral of outer diameter of 1.20". This size is acceptable within the confines of the frame, however, it leads to a drum to inner diameter ratio of approximately 2:1. The weight of the sash is initially increased four-fold as it passes through the reduction block and the total force increase through the system is 4 multiplied by 2, or 8:1. Since the drum diameter cannot be reduced significantly, the inner diameter of the spiral must be increased to reduce the total force multiplication. This leads to the second problem.

There is a great deal of rotational travel in the spiral for very small changes in "r" near the inner diameter. As the radius increases, the effect decreases, as does the rotational travel. At larger diameters, there is very little rotational change between large changes in radius. In order to properly design a spiral/drum system, the spiral must be designed to rotate through the same number of revolutions as is necessary for the drum to wrap the required sash cord. Because of the large rotational changes at the smaller radius, most of the spiral length is concentrated at a small mean radius. If even a small increase is made to the inner radius, a substantial increase must be made to the outer radius to compensate for the loss in rotational travel at the smaller radius. Moreover, the force ratio between the inner and outer radius of the spiral increases dramatically. For a 100 pound sash, for example, the force ratio will cause a marked decrease in the life of any connecting cord, as it is cycled back and forth between approximately 100 pounds and 650 pounds of force.

A third problem is that of force location. When the sash is lowered, the spiral rotates and extends the spring. As the spring extends, its force increases and the spiral radius decreases. When the sash is at the bottom of its travel, the spring is extended to its fullest length and therefore exerts the greatest force in the system. This high force is applied to the smallest radius of the entire spiral and creates very high compressive stresses in the spiral, which can cause premature failure of the spiral at this point. An alternative means for counterbalancing a sash, or the like, was developed to overcome those problems of the initial breakthrough. The underlying concept of this invention is to separate the independent and dependent variables of Equation 5, so as to be in a "balanced" relationship. Accordingly, the constant force of the sash was applied to the radially changing spiral and the force of the linearly changing spring was applied to the constant radius drum, so that Equation 1 is rewritten as Equation 7.

$$F \cdot y = x \cdot r_d \qquad \text{Equation 7}$$

wherein:

F=sash force;

y=spiral radius;

x=spring force; and, rd=drum radius.

In this arrangement, which is illustrated schematically in FIG. 1*a*, the moments on both sides of the system are changing whenever the sash is in motion, but they are compensating each other and maintaining a net zero torque on the compound aspect of the system as a whole. The system has accordingly been designated the Zero Torque Spiral System (ZTS). In order to accomplish this net zero torque, the equation which determines the spiral plot had to be developed. The moment on the spiral side of the system is equal to the force from the sash multiplied by the radius of the spiral, as a function of its rotational position. The opposing moment is caused by the linearly changing spring force on the drum. Equating these factors to maintain a zero torque at any rotational position yields Equation 8.

$$F \cdot r(\theta) = F_s \cdot r_d \qquad \text{Equation 8}$$

wherein:

F=sash force;

$r(\theta)$=spiral radius as a function of rotational position;

$F_s$=spring force; and, $r_d$=drum radius.

Since the spring force is a function of the spring's linear extension due to the rotation of the drum, this extension is a function of the drum radius. For each full revolution of the drum the spring will extend as shown in Equation 9.

$$L = 2\pi r_d \qquad \text{Equation 9}$$

wherein:

L=length of spring extension per revolution; and, $r_d$=drum radius.

The force due to this extension is equal to the product of the spring constant and the spring's extension as shown in Equation 10.

$$F_s = K \cdot 2\pi r_d \qquad \text{Equation 10}$$

wherein:

$F_s$=spring force per revolution;

K=spring constant; and, $r_d$=drum radius.

This is the spring force achieved after one revolution of the drum. Since there are $2\pi$ radians in each revolution, the spring force per radian can be determined and, if there are $\theta$ radians in the rotation of the drum through any fractional rotation, the spring force at any rotational point is shown in Equation 11.

$$F_s = K\theta r_d \text{ lbs.} \qquad \text{Equation 11}$$

wherein:

$F_s$=spring force;

$r(\theta)$=spiral radius as a function of rotational position;

K=spring constant;

$r_d$=drum radius; and, $\theta$=rotational position of spiral.

Substituting this into Equation 8 and solving for $\theta$ results in Equation 12, which defines the Zero Torque Spiral.

$$\theta = \frac{F \cdot r(\theta)}{K \cdot (r_d)^2} \qquad \text{Equation 12}$$

where:

F=sash force;

$r(\theta)$=spiral radius as a function of rotational position;

K=spring constant;

$r_d$=drum radius; and, $\theta$=rotational position of spiral.

At any point on the spiral and at any position of the sash, the sash force, spring constant and drum radius will be constant at all times. Accordingly, these terms may be factored out of formulating the spiral radius, yielding Equation 13.

$$\theta = a\, r(\theta) \qquad \text{Equation 13}$$

wherein:

wherein:

$$a = \frac{F}{K \cdot r_d^2}$$

Equation 13 proves to be the general form for an Archimede's spiral and defines a linear relationship between the rotational and radial positions of the spiral.

Since "r" is now a linear function of the rotational position of the spiral and the spring force is a linear function of the spring extension, both "x" and "y" of Equation 7 are raised to the first power as shown in Equation 14.

$$F \cdot y^1 = x^1 \cdot r_d \qquad \text{Equation 14}$$

wherein:

F=sash force;

y=spiral radius;

x=spring force; and, $r_d$=drum radius.

This can be illustrated in the alternative form of independent and dependent variables, as shown in Equation 15.

$$independent \cdot dependent^1 = dependent^1 \cdot independent \qquad \text{Equation 15}$$

By separating the dependent variables, the general moment equation has been reduced to a direct linear relationship between both sides of the equation. For a unit change in the "y" parameter, there will be an equivalent unit change in the "x" parameter.

The theoretical analysis is well summarized by typical graphs of rotational versus radial data. Data for the unbalanced relationship is shown in FIGS. 2*b* and 2*c*. FIG. 2*b* illustrates the exponential relationship between the spiral radius and its corresponding rotation. FIG. 2*c* shows a very steep slope in this relationship for small radii and a slope which approaches zero very rapidly as the radius is increased. This accounts for very little change in spiral rotation even through large ranges of radius. FIGS. 2*b* and 2*c* graphically illustrate the concentration of the exponential spiral in an area of small radius with a considerable waste of space in the large radii. Data for the direct linear relationship of the Zero Torque Spiral System is shown in FIGS. 1*b* and 1*c*. As is shown in FIG. 1*b*, there is a direct and constant increase of rotation by 10 radians for every 0.50 inch increase in spiral radius. Another difference is the length of the Zero Torque Spiral over the exponential spiral. Traveling between the same radii, the exponential spiral has a length of 8.08 inches while the Zero Torque Spiral has a length of 21.86 inches. For a given 5:1 reduction ratio, this allows the Zero Torque Spiral a sash travel capability of 109.3 inches versus 48.0 inches for the exponential spiral. In this configuration, the maximum force in the exponential spiral is 175 lbs. while the maximum force in the Zero Torque Spiral is 262.5 lbs.; however, equating maximum force yields a Zero Torque Spiral of outer radius equal to 1.0 inch with a spiral length of 9.38 inches. This allows a sash travel of 46.9 inches which is 1.1 inches shorter than the larger exponential spiral. The Zero Torque Spiral has its maximum force on its 1.0 inch diameter drum in either situation, as opposed to the exponential spiral which has 175 lbs. on a 0.50 inch diameter inner radius.

A number of problems are solved with the development of the Zero Torque Spiral System. The first and most important of these is the relocation of the maximum force in the system. At all points on the spiral, from inner to outer radius, the force is constant, and is the force due to the sash through the reduction block (constant rate of movement system). The point at which the higher forces due to the extension of the spring are located is on the constant radius drum. The drum is of a radius which is consistently larger than the inner radius of the spiral and, for design considerations, is as large as possible. In addition, the force on the drum is distributed over a larger, more uniform cross-sectional area rather than on the single groove of the inner radius of the spiral. This leads to a greatly reduced potential for material failure in this area due to compressive loading.

The second improvement is that of the linear relationship of the spiral radius. Since the spiral is linear in configuration, the greater portion of the spiral travel is in a larger mean radius and the relationship between the inner and outer radii is linear, so that a change in one radius will cause a comparable change in the other. Because the force concentration on the spiral is no longer a consideration, it is not necessary to increase the inner radius to compensate for this; however, certain connecting cords and cables have minimum bend radii and if it were necessary to increase the inner radius, it would not drastically affect the outer radius.

The forces in the ZTS are, in general, the same to somewhat less then those in the unbalanced system, depending upon the design of the system. Importantly, however, the forces in the zero torque spiral system are applied at locations where they are much more tolerable and easier to deal with.

SUMMARY OF THE INVENTION

It is an object of this invention to provide an improved counterbalance system for window sashes and the like.

It is another object of this invention to provide a compound counterbalance system for window sashes and the like.

It is yet another object of this invention to provide a compound counterbalance system for window sashes and the like, wherein variable operating forces are balanced against one another for more effective load distribution and longer operational life.

It is yet another object of this invention to provide a compound counterbalance system for window sashes and the like, which can accommodate highly efficient weather seals and heavily insulated sashes, and at the same time, is easy to operate, and can be operated with substantially constant effort.

It is yet another object of this invention to provide a compound winding apparatus for counterbalance systems and the like.

It is yet another object of this invention to provide an improved method for counterbalancing.

It is yet another object of this invention to provide a compound counterbalance system in which the effective magnitude of the biasing force can be easily adjusted.

These and other objects of this invention are accomplished by a compound counterbalance system for window sashes and the like, comprising: biasing means for easing operation of a window sash and the like, the biasing means being movable at an inherently variable rate of force; a first biasing force transmission means having fixed rate of movement means connected to the biasing means and variable rate of movement means connected to the window sash and the like, the variable rate of movement means having a variable rate of operation predetermined to automatically compensate for the variability of the biasing means to provide substantial constancy of the biasing force throughout an operating range; and, cable means for interconnecting the biasing means, the first biasing force transmission means, and the window sash and the like, whereby loading forces on the first biasing force transmission means are substantially constant throughout the operating range. The compound counterbalance system may further comprise a second biasing force transmission means connected intermediately of the variable rate of movement means and the window sash and the like, for increasing the effective range of movement of the biasing means. The compound counterbalance system may also comprise means for adjusting the effective magnitude of the biasing force throughout the operating range, so that, for example, the same spring can be used with sashes of different weights. Such adjusting means may be embodied in cable drums of different diameter fixed together for rotation and operatively disposed between the biasing means and the first biasing force transmission means.

The first biasing force transmission means may comprise a generally conical, spiral-grooved pulley and a cable drum fixed for rotation together. A first cable means may be provided for interconnecting the biasing means and the cable drum; and, second cable means may be provided for interconnecting the spiral-grooved pulley and the window sash and the like. In those embodiments employing a second biasing force transmission means, first cable means may be provided for interconnecting the biasing means and the cable drum; second cable means may be provided for interconnecting the spiral-grooved pulley and the second biasing force transmission means; and, third cable means may be provided for interconnecting the second biasing force transmission means and the window sash and the like.

The second biasing force transmission means may comprise a block and tackle assembly formed by pulleys and cable means, the cable means being entrained around the pulleys to impart a mechanical ratio and being connected to the window sash and the like, for example, forming at least part of the third cable means. Alternatively, the second biasing force transmission means may comprise at least one reduction gear assembly.

These and other objects are also accomplished by a compound counterbalance system as described above, in combination with a manufactured window assembly having at least one movable sash. In such a combination, the biasing means may comprise a linearly extensible spring having one fixed end and one movable end; and, the first biasing force transmission means may comprise a generally conical, spiral-grooved pulley and a cable drum fixed for rotation together, the fixed end of the spring being disposed toward the pulley and drum. First cable means may be provided for interconnecting the movable end of the spring and the cable drum; and, second cable means may be provided for interconnecting the spiral-grooved pulley cable drum and the window sash and the like. In a presently preferred embodiment, the first cable means runs axially through the center of the spring. The first and second cable means may extend from the spiral-grooved pulley and the cable drum, respectively, substantially at a right angle to one another, the spring being disposed along the top of the window assembly and the spiral-grooved pulley and cable drum being disposed adjacent a top corner of the window assembly.

These and other objects of the invention are also accomplished by a method for counterbalancing a load, comprising the steps of: exerting by movement an inherently invariable biasing force to counteract gravitational and frictional forces on the load tending to undesirably effect movement of the load; directing the biasing force to act on a fixed rate of movement means; directing the load forces to act on a variable rate of movement means, the variable rate of movement means having a variable rate of operation predetermined to automatically compensate for the variability of the biasing force to provide substantial constancy of the biasing force throughout an operating range; and, operatively engaging the fixed rate of movement means and the variable rate of movement means with one another to form a biasing force transmission means, whereby net forces acting on the biasing force transmission means are substantially constant throughout the operating range. The method may further comprise the step of increasing the effective range of movement of the biasing means, for example by interposing movable means, imparting a mechanical ratio, between the biasing force transmission means and the load.

Other objects and advantages of this invention will become apparent to those skilled in the art from the following detailed description of the preferred embodiments of the invention.

BRIEF DESCRIPTION OF THE DRAWINGS

There are shown in the drawings forms which are presently preferred; it being understood, however, that the invention is not limited to the precise arrangements and instrumentalities shown.

DETAILED DESCRIPTION OF THE PREFERRED EMBODIMENTS

Figure 1A:
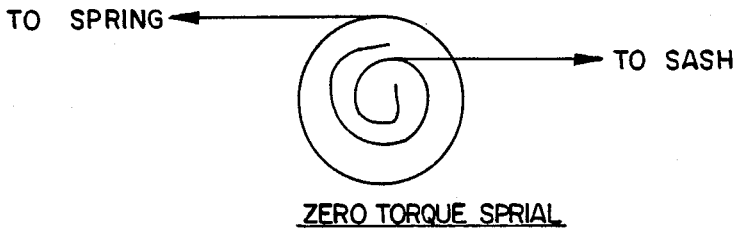
FIG. 1*a* is a diagrammatic representation of a Zero Torque Spiral according to this invention.

Compound winding systems according to this invention, and incorporating Zero Torque Spirals, are chiefly embodied in compound counterbalance systems for window sashes and the like. Each of the compound counterbalance systems comprises three principal subsystems or assemblies, namely: a biasing means for easing operation of a window sash and the like, the biasing means being movable at an inherently variable rate of force; a first biasing force transmission means having fixed rate of movement means connected to the biasing means and variable rate of movement means connected to the window sash and the like, the variable rate of movement means having a variable rate of operation predetermined to automatically compensate for the variability of the biasing means to provide substantial constancy of the biasing force throughout an operating range; and, cable means for interconnecting the biasing means, the first biasing force transmission means and the window sash and the like, whereby loading forces on the first biasing force transmission means are substantially constant throughout the operating range. The compound counterbalance system may further comprise a second biasing force transmission means connected intermediately of the variable rate of movement means and the window sash and the like, for increasing the effective range of movement of the biasing means. Finally, the compound counterbalance system may also comprise means for adjusting the effective magnitude of the biasing means throughout the operating range, so that the same spring, for example, can be used with sashes of different weights. The magnitude adjusting means may be connected intermediately of the biasing means and the first biasing force transmission means.

An off-site manufactured window assembly 10 incorporating a compound counterbalance winding system according to this invention, is shown in part in FIGS. 3–6. The window assembly 10 comprises a frame 12 having horizontal and vertical members, including a generally horizontal header 14. The window assembly 10 includes one or more movable window sashes 16. Each window sash 16 generally comprises horizontal and vertical members, including a lower rail 18 and a side rail 20. Such windows may be provided with one or more panes of glass 22. The terms horizontal and vertical are used for purposes of convenience, and it is not absolutely necessary that the window assembly be disposed vertically.

The window sash 16 shown in the drawings is representative of a window assembly having one openable sash, as well as one of the sashes of a window assembly having two or more openable sashes. Operation of the invention is the same for both upper and lower sashes, as would be found in a typical window assembly.

Among the objects of any counterbalance system are to ease upward movement of lower sashes for opening and upper sashes for closing; and, to prevent accidental downward movement or dropping of lower sashes for closing and upper sashes for opening. For purposes of convenience only, and to facilitate description, the window sash 16 shown in FIG. 3 will be deemed to be a lower sash, which opens by upward movement and closes by downward movement.

Biasing means 30 are mounted on the top of the header 14. The biasing means 30 generally comprises a support sleeve 32, a support sleeve base 42, a spring 48 and a spring engaging ring 50. The support sleeve is secured to a clamp 34 by one or more bolts, rivets or the like 38, clamp 34 being affixed to the header 12 by screws or the like 36. The sleeve 32 and sleeve base 42 are connected to the base of a yoke 40, such that spring engaging ring 50 is free to move axially along the support sleeve 32 without hitting header 14. A bore 44 in the base of the yoke 40 and sleeve base 42 communicates with the interior of the support sleeve 32. A wide variation of brackets and flanges may be provided for securing yoke 40 to the header 14 and are omitted for purposes of clarification. It may be necessary to form slots or channels or through holes in the top of header 14 to accommodate various parts or cable runs of the invention, depending upon how much clearance is available. Such details are also omitted for purposes of clarification.

Support sleeve 32 is provided with opposing longitudinal slots 46, defining an actual range of movement for the biasing means. A section 56 of first cable means 54 is disposed in support sleeve 32, entering through bore 44 and secured to a pin 52. Pin 52 is disposed in slots 46, on that side of spring engaging ring 50 opposite spring 48. The end of cable section 56 may be looped around pin 52 and secured by cable clamp 64. Movement of cable section 56 out of the support sleeve 32 through bore 44 (to the right, in the sense of FIG. 3) will pull pin 52 in the same direction. Pin 52 presses against ring 50, which in turn presses against the end of, and thereby compresses spring 48. The other end of spring 48 is retained against sleeve base 42. Such movement corresponds to window sash 16 being lowered. Such movement will preload or cause energy to be stored in compressed spring 48 so that, upon subsequent raising of window sash 16, the preloaded or stored force can be utilized to tighten the load of raising the sash. At the same time, the force with which the spring tends to resist compression prevents the window sash from accidentally falling from a raised position. In an ideally balanced system, the sash can be easily raised and lowered, and will hold its position at any location between the upper and lower limits of movement. It is an inherent characteristic of such springs to exert force at a variable rate, depending upon the extent to which the spring is extended or compressed.

Figure 1B:
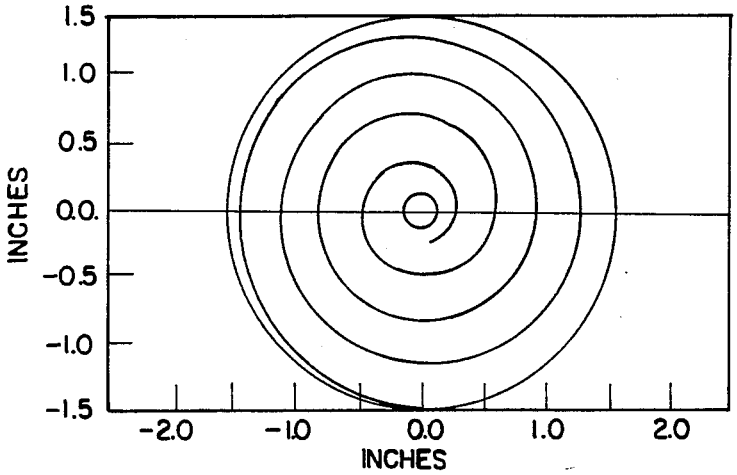
FIG. 1*b* is a rotational plot of a Zero Torque Spiral according to this invention.
Figure 1C:
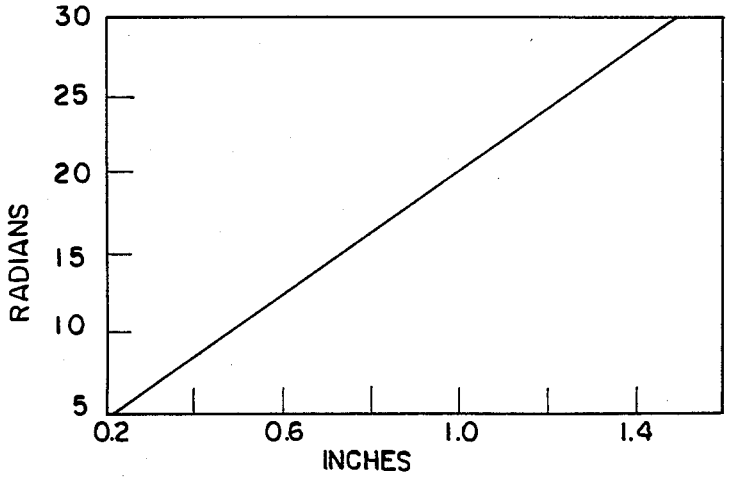
FIG. 1*c* is a plot of radial data for a Zero Torque Spiral according to this invention.
Figure 2A:
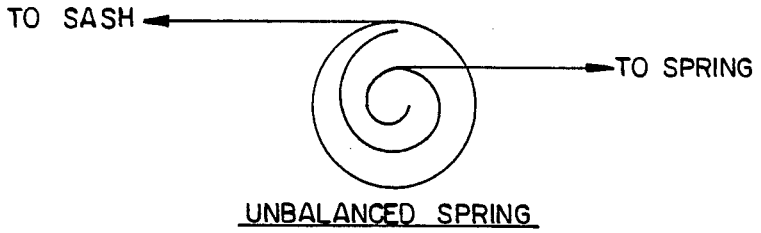
FIG. 2*a* is a schematic representation of an unbalanced spring spiral, from which FIG. 1*a* may be readily distinguished.
Figure 2B:
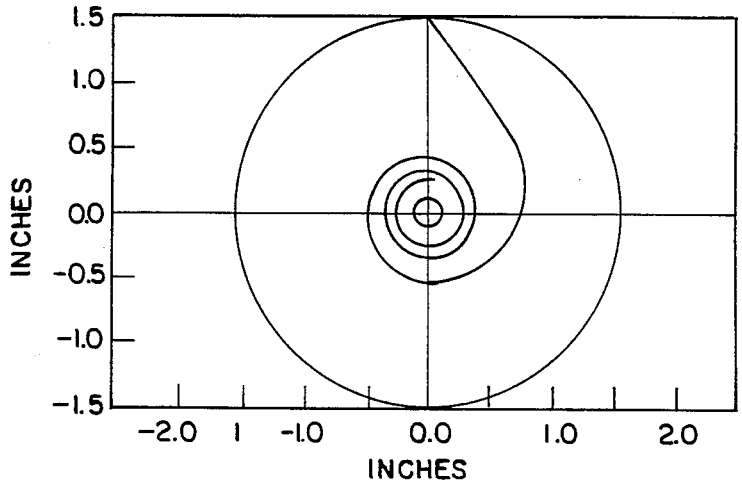
FIG. 2*b* is a rotational plot of an unbalanced spring spiral, from which FIG. 1*b* may be readily distinguished.
Figure 2C:
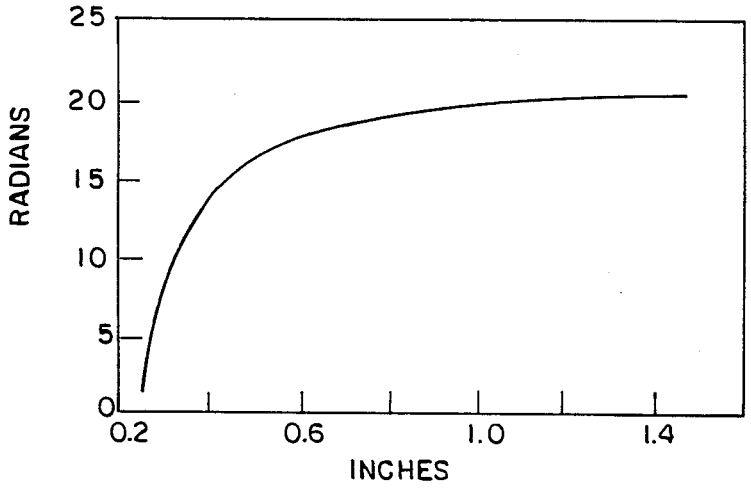
FIG. 2*c* is a plot of radial data for an unbalanced spring spiral, from which FIG. 1*c* may be readily distinguished.

A first biasing force transmission means 70 comprises a fixed rate of movement means 72 and a variable rate of movement means 74. The fixed rate of movement means 72 is embodied in a cable drum of constant diameter, whereas the variable rate of movement means is embodied as a conical or spiral pulley of varying diameter. A section 60 of first cable means 54 engages the fixed and variable rate of movement means 72 and 74. The drum and spiral portions of the fixed and variable rate of movement means are preferably fixed for rotation together, about an axle or spindle 76, mounted in the arms of yoke 40. Movement of cable section 60 through the first biasing force transmission means is guided from the surface of drum portion 72 to a spiral groove 80 in conical portion 74. The spiral configuration of groove 80 is preferably as described and shown in FIGS. 1*a*, 1*b* and 1*c*. The drum surface and groove 80 communicate with one another through a hole or a notch 82. In an embodiment which is not provided with magnitude adjusting means 140, the biasing means and the drum 72 are connected directly to one another.

The compound counterbalance and winding system may further comprise a second biasing force transmission means 100, operatively interposed between the variable rate of movement means 74 of the first biasing force transmission means 70 and the window sash and the like 16. The second biasing force transmission means 100, which is characterized by a constant rate of movement and a mechanical "advantage", is preferably embodied as a block and tackle system. An upper bracket 102 defines a movable end of a block and tackle system and a lower bracket 104 defines a fixed end of the block and tackle system. Freely rotatable pulleys 106 and 108 are mounted in upper bracket 102 and freely rotatable pulleys 110 and 112 are mounted in lower bracket 104. Lower bracket 104 is provided with a flange 114, which is preferably adapted to mount in the slide channel of the vertical member of the window frame 12, by screws, rivets of the like. Typically, window sashes are mounted to sliders 118, which travel in the channels of the vertical sides of the window frames. Window sashes are typically removably and pivotally connected to such sliders. Accordingly, sliders are generally attached to the lower rails 18 of such sashes. For both upper and lower sashes, the sliders 118 move only in the lower half, or not much more than the lower half of each channel. Accordingly, there is ample room for the block and tackle system 100 in the upper section of each channel. When this invention is applied to a window assembly having both upper and lower openable sashes, a compound counterbalance such as shown in FIGS. 3–6 may be provided for each side of each sash.

A second cable means 120 is fixed at one end to slider 118. Cable 120 is then directed upwardly, and entrained around pulley 108, directed downwardly, and entrained around pulley 112, directed upwardly, and entrained around pulley 106, directed downwardly, and entrained around pulley 110, directed upwardly, and then fixed to upper or movable bracket 102. Section 62 of first cable means 54 is fixed to bracket 102 by cable clamp means 116. In the absence of the second biasing force transmission means 100, the biasing means 30, the first biasing force transmission means 70 and the window sash and the like 16 are interconnected by first cable means 54. In the presence of a second biasing force transmission means 100, the biasing means 30, the first biasing force transmission means 70 and the second biasing force transmission means 100 are interconnected by first cable means 54; and, the second biasing force transmission means 100 and the sash and the like 116 are interconnected by second cable means 120.

The compound counterbalance system may also comprise means 140 for adjusting the effective magnitude of the biasing force throughout the operating range, in order to standardize the systems and enable a relatively small number of such systems to be utilized with a relatively large number of window assemblies having window sashes of different sizes and weight. The magnitude adjusting means 140 are operationally interposed between the biasing means 30 and the first biasing force transmission means 70. The magnitude adjusting means 140 may be embodied as a larger drum 142 and a smaller drum 144, larger and smaller with respect to one another, mounted for rotation about axle or spindle 146 in the arms of yoke 40. Movement of cable section 58 around the larger and smaller drums 142 and 144 is guided by groove 148. Groove 148 extends essentially through a full circle, or 360 degrees, but has ends offset from one another as shown most clearly in FIG. 4. Half of the groove 148 is on the larger drum 142 and half of the groove 148 is on the smaller drum 144. The extent to which the effective magnitude of the biasing force will be changed is dependent upon the ratio of the diameters of the larger and smaller drums. Accordingly, it is expected that such magnitude adjusting means will be manufactured with a standard size larger drum, which can be fixed for rotation with and to any one of a plurality of smaller drums of varying diameter.

Figure 3:
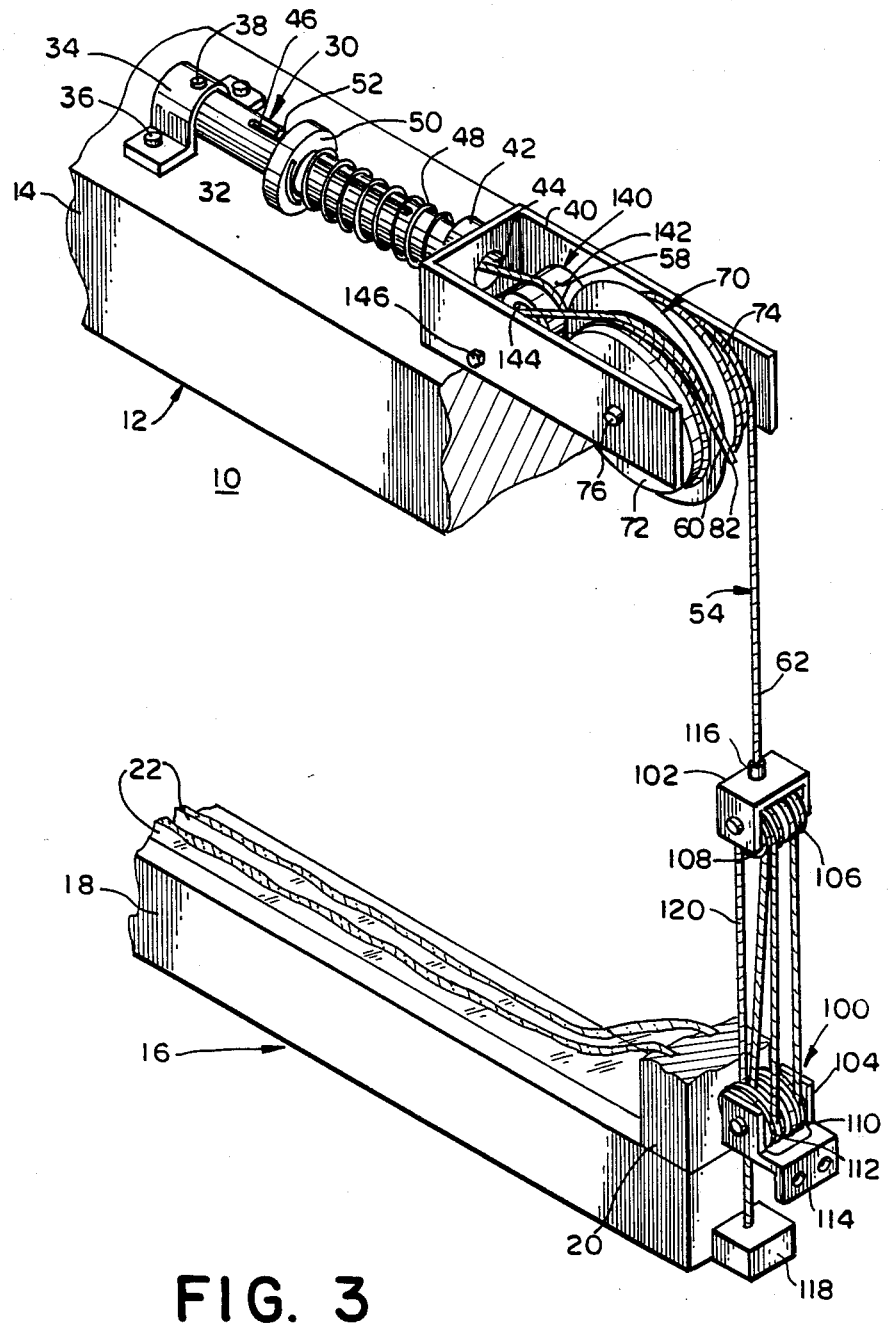
FIG. 3 is an isometric view of a compound counterbalance system according to this invention, utilizing a Zero Torque Spiral.
Figure 4:
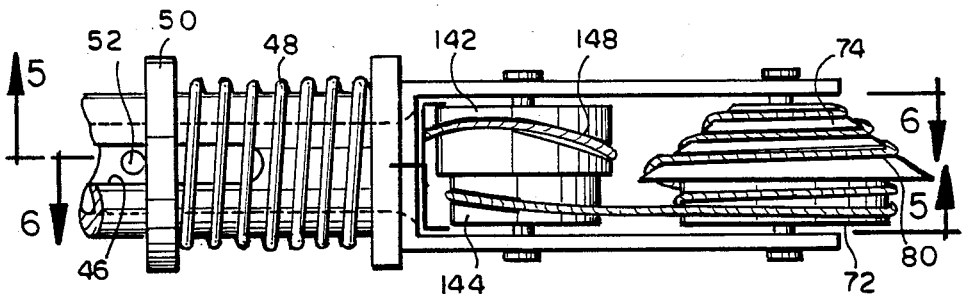
FIG. 4 is a top plan view of FIG. 3.
Figure 5:
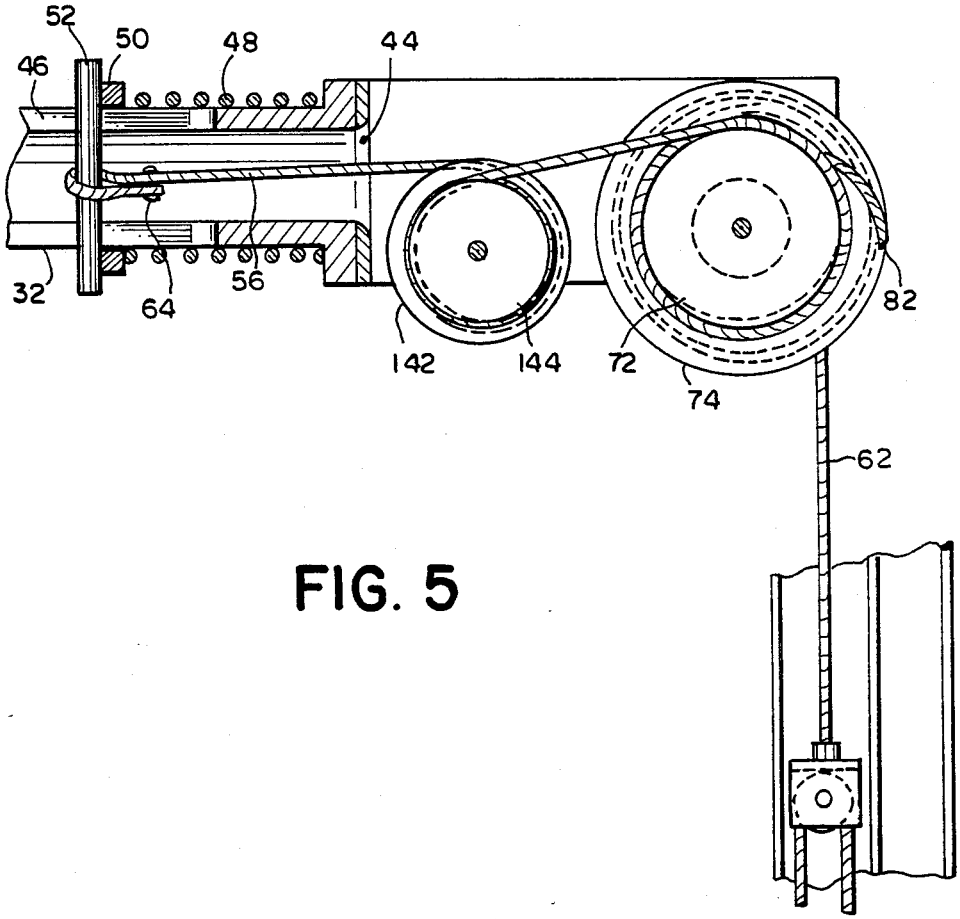
FIG. 5 is a section view taken along the line 5—5 in FIG. 4.
Figure 6:
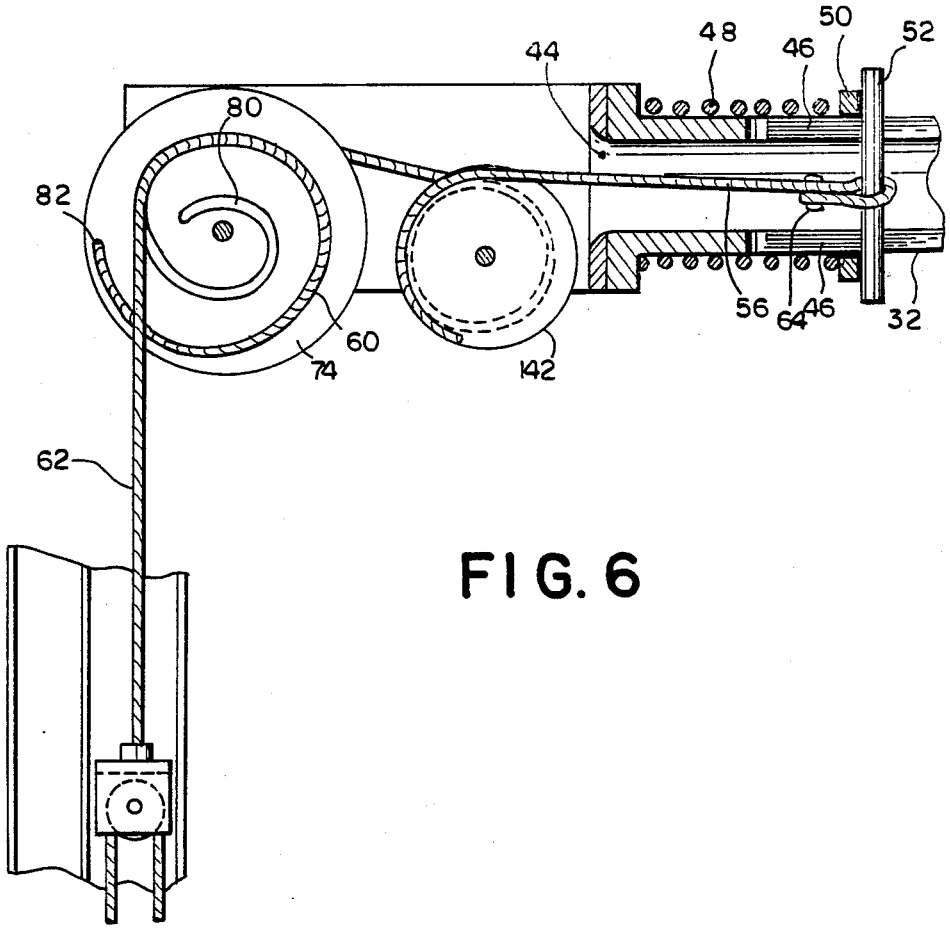
FIG. 6 is a section view taken along the line 6—6 in FIG. 4.

With regard to the orientation of FIG. 3, movement of the window sash and the like 16 in a downward direction will result in movement of pin 52 to the right, compression of spring 48, clockwise rotation of the magnitude adjusting means 140 and the first biasing force transmission means 70 and downward movement of upper bracket 102 of the second biasing force transmission means 100. On the other hand, upward movement of the window sash and the like 16 will result in upward movement of upper bracket 102 of the second biasing force transmission means, counter clockwise rotation of the first biasing force transmission means 70 and the magnitude adjusting means 140 and axial extension or decompression of spring 48.

The invention can be utilized in contexts other than window sash balance systems and the like, and accordingly, the invention may also be embodied in a compound winding apparatus, comprising: a biasing means exerting a variable biasing force; a generally conical, spiral-grooved pulley adapted to engage a first cable section means windable into and out of the spiral groove at a variable rate as the pulley rotates, the first cable section means being connectable to a load; a drum portion adapted to engage a second cable section means and windable onto and off of the drum at a substantially constant rate as the drum rotates, the second cable means being connected to the biasing means; the pulley and the drum being at least indirectly engaged to undergo simultaneous rotation; and, the variable rate being predetermined to automatically compensate for inherent variation in a biasing force transmitted through the first and second cable section means, whereby a substantially constant force is transmitted through the first and second cable means and load forces on the spiral-grooved pulley are substantially constant. According to various embodiments of such a compound winding apparatus, the pulley and the drum may be fixed to one another for rotation at the same speed and in the same direction, by being fixed to a common shaft for rotation or by being formed integrally with one another or by being fixed to one another for common rotation on a shaft. Alternatively, the pulley and the drum may be indirectly linked by mechanical means for rotation at the same speed or for rotation at different speeds. Rotation at different speeds may be achieved, for example, by mechanical means comprising at least one reduction gear assembly, the drum being connected for rotation at a speed faster than the spiral pulley by a multiple related to the reduction ratio of the at least one gear assembly. In either case, at least one gear may be formed integrally with each of the pulley and the drum. The compound winding apparatus may further comprise a block and tackle means imparting a mechanical advantage in operation, having a movable end connected by the first cable section means, and a pulley-entrained third cable section means having a free end which moves through a first range of movement larger than a second range of movement defined by the first cable section means by a multiple related to the ratio of the mechanical advantage of the block and tackle means. The first and second cable section means may be part of the same cable means.

The invention also comprises a method for counterbalancing a load comprising the steps of: exerting a biasing force by movement throughout an operating range; transmitting the biasing force to a fixed rate of movement means; transmitting the biasing force from the fixed rate of movement means to a movement compounding means; subjecting the biasing force to a variable rate of movement predetermined to automatically compensate for characteristic variability of the biasing force, the compounded biasing force being substantially constant; and, transmitting the compounded biasing force to a load, whereby the biasing force is applied substantially uniformly throughout the operating range.

The specific dimensions, spring gradients and the like of any particular compound counterbalance system according to this invention, irrespective of the nature of the particular mechanical embodiment, will inevitably vary for windows or other loads of different size, shape, weight and choice of materials in slides and tracks. However, several restraints and operating factors are common to all such systems, particularly windows, such as size, weight and coefficients of friction (sliding and static), and a consideration of such restraints will enable those skilled in the art to practice the method and apply the teachings of this invention in specific instances.

This invention may be embodied in other specific forms without departing from the spirit or essential attributes thereof. Accordingly, reference should be made to the appended claims, rather than to the foregoing specification, as indicating the scope of the invention.

What is claimed is:

1. A compound counterbalance system for a load such as a window sash and the like, comprising:

biasing means for easing operation of the load, the biasing means being characterized by an inherently variable rate of force;

a first biasing force transmission means having a fixed rate of movement means connected to the biasing means and variable rate of movement means connected to the load, the variable rate of movement means having a variable rate of operation predetermined to automatically compensate for the variability of the biasing means to provide substantial constancy of the biasing force as applied to the load, throughout an operating range; and, a second biasing force transmission means, connected between the first biasing force transmission means and the load, for increasing the operating range of the biasing means, the second biasing force transmission means including a block and tackle assembly.

2. A compound counterbalance system for a load such as a window and the like, comprising:

biasing means for easing operation of the load, the biasing means being characterized by an inherently variable rate of force;

a first biasing force transmission means having a fixed rate of movement means connected to the biasing means and variable rate of movement means connected to the load, the variable rate of movement means having a variable rate of operation predetermined to automatically compensate for the variability of the biasing means to provide substantial constancy of the biasing force as applied to the load, throughout an operating range, and wherein the predetermined variable rate of operation of the variable rate of movement means varies linearly throughout the operating range, to equalize load stresses on the variable rate of movement means throughout the operating range; and, a second biasing force transmission means, connected between the first biasing force transmission means and the load, for increasing the operating range of the biasing means, the second biasing force transmission means including a block and tackle assembly.

3. The compound counterbalance system of claim 1, further comprising means for adjusting the magnitude of the biasing force throughout the operating range, connected between the biasing means and the first biasing force transmission means.

4. The compound counterbalance system of claim 1, further comprising cable means for interconnecting the biasing means, the first biasing force transmission means and the load.

5. The compound counterbalance system of claim 1, further comprising:

first cable means for interconnecting the biasing means, the first biasing force transmission means and the second biasing force transmission means; and, second cable means for interconnecting the second biasing force transmission means and the load.

6. The compound counterbalance system of claim 3, comprising cable means for interconnecting the biasing means, the magnitude adjusting means, the first biasing force transmission means and the load.

7. The compound counterbalance system of claim 1, wherein the first biasing force transmission means comprises a generally conical spiral-grooved pulley and a cable drum fixed for rotation together.

8. The compound counterbalance system of claim 3, wherein:

the first biasing force transmission means comprises a generally conical spiral-grooved pulley and a cable drum fixed for rotation together; and, the adjusting means comprises second and third cable drums fixed for rotation together.

9. A manufactured window assembly, comprising:

at least one openable sash connected to at least one compound counterbalance system, including biasing means for easing operation of the at least one openable sash, the biasing means being characterized by an inherently variable rate of force, and the biasing means being disposed substantially within a frame of the manufactured window assembly, the biasing means including:

a first biasing force transmission means having a fixed rate of movement means connected to the biasing means and variable rate of movement means connected to the at least one sash, the variable rate of movement means having a variable rate of operation predetermined to automatically compensate for the variability of the biasing means to provide substantial constancy of the biasing force throughout the operating range; and, a second biasing force transmission means, connected between the first biasing force transmission means and the at least one sash, for increasing the operating range of the biasing means, the second biasing force transmission means including a block and tackle assembly.

10. The manufactured window assembly of claim 9, further comprising means for adjusting the magnitude of the biasing force throughout the operating range, connected between the biasing means and the first biasing force transmission means.

11. The manufactured window assembly of claim 9, further comprising cable means for interconnecting the biasing means, the first biasing force transmission means and the at least one sash.

12. The manufactured window assembly of claim 9, further comprising:

first cable means for interconnecting the biasing means, the first biasing force transmission means and the second biasing force transmission means; and, second cable means for interconnecting the second biasing force transmission means and the at least one sash.

13. The manufactured window assembly of claim 10, comprising cable means for interconnecting the biasing means, the magnitude adjusting means, the first biasing force transmission means and the sash.

14. The manufactured window assembly of claim 9, further comprising:

first cable means for interconnecting the biasing means, the magnitude adjusting means, the first biasing force transmission means and the second biasing force transmission means; and, second cable means for interconnecting the second biasing force transmission means and the at least one sash.

15. The manufactured window assembly of claim 9, wherein the first biasing force transmission means comprises a generally conical spiral-grooved pulley and a cable drum fixed for rotation together.

16. The manufactured window assembly of claim 10, wherein:

the first biasing force transmission means comprises a generally conical spiral-grooved pulley and a first cable drum fixed for rotation together; and, the adjusting means comprises second and third cable drums fixed for rotation together.

17. A method for counterbalancing a load, comprising the steps of: exerting a biasing force by movement through an operating range;

transmitting the biasing force to a fixed rate of movement means;

transmitting the biasing force from the fixed rate of movement means to a movement compounding means;

subjecting the biasing force to a variable rate of movement predetermined to automatically compensate for characteristic variability of the biasing force, a compounded biasing force produced by the biasing force being transmitted through the fixed rate of movement means and the movement compounding means, and said compound biasing force being substantially constant;

transmitting the compounded biasing force to a load, through a mechanical system configured to increase the operating range of movement in which the biasing force is effective while reducing a size of the mechanical system, whereby the biasing force is applied substantially uniformly throughout the operating range.

18. The method of claim 17, comprising the further step of adjusting the magnitude of the exerted biasing force throughout the operating range, prior to transmission of the biasing force to the fixed rate of movement means.

19. The method of claim 17, wherein said transmitting of the biasing force to the load is accomplished by routing a cable between the fixed rate of movement means through plural passes between spaced pulleys in a block and tackle assembly.

20. The method of claim 17, comprising the step of equalizing load stresses on the movement compounding means throughout the operating range by subjecting the biasing force to a linerally variable rate of movement throughout the operating range.

* * * * *